US007549631B2

(12) United States Patent
Tsuchida

(10) Patent No.: US 7,549,631 B2
(45) Date of Patent: Jun. 23, 2009

(54) SHEET FEEDING APPARATUS AND IMAGE FORMING APPARATUS

(75) Inventor: Takeshi Tsuchida, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 10/788,310

(22) Filed: Mar. 1, 2004

(65) Prior Publication Data

US 2004/0178563 A1 Sep. 16, 2004

(30) Foreign Application Priority Data

Mar. 7, 2003 (JP) ..... 2003-061692

(51) Int. Cl.
*B65H 1/00* (2006.01)

(52) U.S. Cl. ..... 271/145; 271/147

(58) Field of Classification Search ..... 271/145, 271/147, 157, 162, 171, 160, 164; 221/227; 399/377

See application file for complete search history.

(56) References Cited

U.S. PATENT DOCUMENTS

| | | | | |
|---|---|---|---|---|
| 3,563,535 | A * | 2/1971 | Vitu et al. | 271/157 |
| 3,689,064 | A * | 9/1972 | Kuksa | 271/164 |
| 4,406,448 | A * | 9/1983 | Kulpa et al. | 271/160 |
| 4,772,007 | A * | 9/1988 | Kashimura | 271/22 |
| 4,900,005 | A * | 2/1990 | Blyth et al. | 271/127 |
| 5,615,873 | A * | 4/1997 | Kobayashi et al. | 271/121 |
| 6,382,617 | B1 * | 5/2002 | Yen et al. | 271/3.14 |

FOREIGN PATENT DOCUMENTS

| | | | |
|---|---|---|---|
| JP | 57-4835 | * | 1/1982 |
| JP | 5-294466 | | 11/1993 |
| JP | 6-72570 | * | 3/1994 |
| JP | 2000-198551 | | 7/2000 |
| JP | 2003-089433 | | 3/2003 |

OTHER PUBLICATIONS

Official Letter/Search Report.

* cited by examiner

*Primary Examiner*—Patrick H Mackey
*Assistant Examiner*—Thomas A Morrison
(74) *Attorney, Agent, or Firm*—Fitzpatrick, Cella, Harper & Scinto

(57) ABSTRACT

A sheet feeding apparatus provided with a sheet stacking portion for supporting sheets thereon, a sheet feeding roller for feeding the sheets stacked on the sheet stacking portion, and a manually moving member for selectively moving the sheet stacking portion between a first position in which sheets stacked on the sheet stacking portion are brought into pressure contact with the sheet feeding roller and a second position in which the stacked sheets are spaced apart from the sheet feeding roller, the manually moving member being disposed above the sheet stacking portion and in a direction orthogonal to a sheet feeding direction, and an image forming apparatus having the sheet feeding apparatus.

12 Claims, 13 Drawing Sheets

SHEET FEEDING APPARATUS AND IMAGE FORMING APPARATUS

BACKGROUND OF THE INVENTION

1. Field of the Invention

The invention relates to a sheet feeding apparatus and an image forming apparatus designed such that sheets stacked on sheet stacking means are brought into pressure contact with sheet feeding means by a lever operation.

2. Description of the Related Art

An image forming apparatus such as a printer or a copying machine has heretofore been provided with a sheet feeding apparatus for feeding a sheet to an image forming portion. As such a sheet feeding apparatus, there is one provided with a cassette feeding portion for feeding sheets contained in a cassette loaded on the bottom of an image forming apparatus main body, and in addition, a multi-feeding portion which is a manually feeding portion designed to stack sheets on a tray drawably or openably and closably provided in the image forming apparatus main body, and feed the sheets by a sheet feeding roller.

FIG. 12 of the accompanying drawings schematically shows the construction of a conventional image forming apparatus provided with such a multi-feeding portion, and in FIG. 12, the multi-feeding portion 140 is openably and closably provided in an image forming apparatus main body 100, and is provided with a tray 145 for stacking sheets P thereon, and a sheet feeding roller 143 rotated in conformity with an image forming operation during image forming to thereby feed the sheets P from the tray 145.

Also, a cassette feeding portion 116 is provided with a cassette 117 loaded on the bottom of the image forming apparatus main body 100, a sheet feeding roller 118 provided in the image forming apparatus main body 100 for feeding sheets P stacked on the intermediate plate 117*a* of the cassette 117 and a pair of retard rollers 119 for separating the sheets P one by one.

Design is made such that when the sheets P are to be fed from the multi-feeding portion 140 to an image forming portion 101, the sheets P are fed one by one from the tray 145 by the sheet feeding roller 143. Also, design is made such that when the sheets P are to be fed from the cassette feeding portion 116 to the image forming portion 101, the sheets P contained in the cassette are separated and fed one by one by the sheet feeding roller 118 and the pair of retard rollers 119. The sheets P thus fed from the multi-feeding portion 140 or the cassette feeding portion 116 are thereafter transported to the image forming portion 101, whereby images are formed thereon.

FIG. 13 of the accompanying drawings shows the construction of such a multi-feeding portion 140, and in FIG. 13, an intermediate plate 146 provided below a sheet feeding roller 143 for pivotal movement in a vertical direction is downwardly pivotally moved as shown in FIG. 14 of the accompanying drawings when the sheets are to be set on the tray 145, and by the intermediate plate 146 being thus pivotally moved, a gap "a" equal to or greater than the thickness of the sheets to be set is formed between the sheet feeding roller 143 and the intermediate plate 146.

By the gap "a" being thus formed between the sheet feeding roller 143 and the intermediate plate 146, the sheets P can be pushed into between the sheet feeding roller 143 and the intermediate plate 146. Thereafter, as shown in FIG. 15 of the accompanying drawings, the intermediate plate 146 is upwardly pivotally moved, whereby the sheets P can be brought into pressure contact with the sheet feeding roller 143, whereby when the sheet feeding roller 143 is rotated, the sheets P come to be fed out. The reference numeral 147 designates a frictional pad adapted to pressure-contact with the sheet feeding roller 143, and design is made such that the sheets P can be separated one by one by this frictional pad 147.

Now, such an intermediate plate is also provided in the cassette 117 of the cassette feeding portion 116, as shown in FIG. 12. In the cassette feeding portion 116, design is made such that when the cassette 117 is contained in the image forming apparatus main body after the sheets P have been set in the cassette 117, an intermediate plate 117*a* is automatically pivotally moved to a position shown in FIG. 12.

On the other hand, in the multi-feeding portion 140, it is also possible to adopt a construction similar to that of the cassette feeding portion 116, but a sheet feeding operation is possible with the tray 145 opened and therefore, with economical properties such as a manufacturing cost and a running cost further taken into account, design is made such that a lever 148 which is manually moving means shown in FIG. 16 of the accompanying drawings is manually operated in a vertical direction to thereby pivotally move the intermediate plate 146 in the vertical direction.

However, in the conventional image forming apparatus provided with the multi-feeding portion 140 designed such that the intermediate plate 146 is pivotally moved by such a lever operation, this lever 148, as shown in FIGS. 13 and 16, is disposed in opposed relationship in a direction (hereinafter referred to as the widthwise direction) orthogonal to the sheet transport direction of the tray 145, and is at a location hidden by a side regulating plate 149 for regulating the position of the sheets in the widthwise direction thereof and therefore, in some cases, a user loses sight of the lever 148.

When the user thus loses sight of the lever 148, the user forgets the lever operation, and when the user thus forgets the lever operation, for example, forgets the operation of upwardly pivotally moving the lever 148, the sheets cannot be pushed in below a sheet feeding roller 143 and therefore, faulty feeding occurs.

Also, when the user forgets the downwardly pivotally moving operation, the sheets cannot be brought into pressure contact with the sheet feeding roller 143 and therefore, even if the sheet feeding roller 143 is rotated, the sheet cannot be fed out, or cannot be fed out to the image forming portion 101 at predetermined timing.

Notes 150 are provided near the lever 148, for example, outside the sheet stacking portion 145*a* of the tray 145 so that the user may not forget the operation even if he notices the lever 148, but the notes 150 provided at such a location are difficult to visually perceive and in some cases, the user does not notice them. When as described above, the user forgets the lever operation even if he notices the lever 148, the sheets cannot be fed.

SUMMARY OF THE INVENTION

So, the present invention has been made in view of such a situation, and has as its object to provide a sheet feeding apparatus which enables a lever to be reliably operated to thereby feed sheets reliably, and an image forming apparatus provided with the same.

The present invention provides a sheet feeding apparatus provided with:

sheet stacking means for supporting sheets thereon;

sheet feeding means for feeding the sheets stacked on the sheet stacking means; and a manually moving member for selectively moving the sheet stacking means to a first position in which the sheets stacked on the sheet stacking means are brought into pressure contact with the sheet feeding means, or a second position in which the stacked sheets are spaced apart from the sheet feeding means, wherein the manually moving member is disposed above the sheet stacking portion of the sheet stacking means and in a direction orthogonal to a sheet feeding direction.

DESCRIPTION OF THE PREFERRED EMBODIMENTS

An embodiment of the present invention will hereinafter be described in detail with reference to the drawings.

Figure 1:
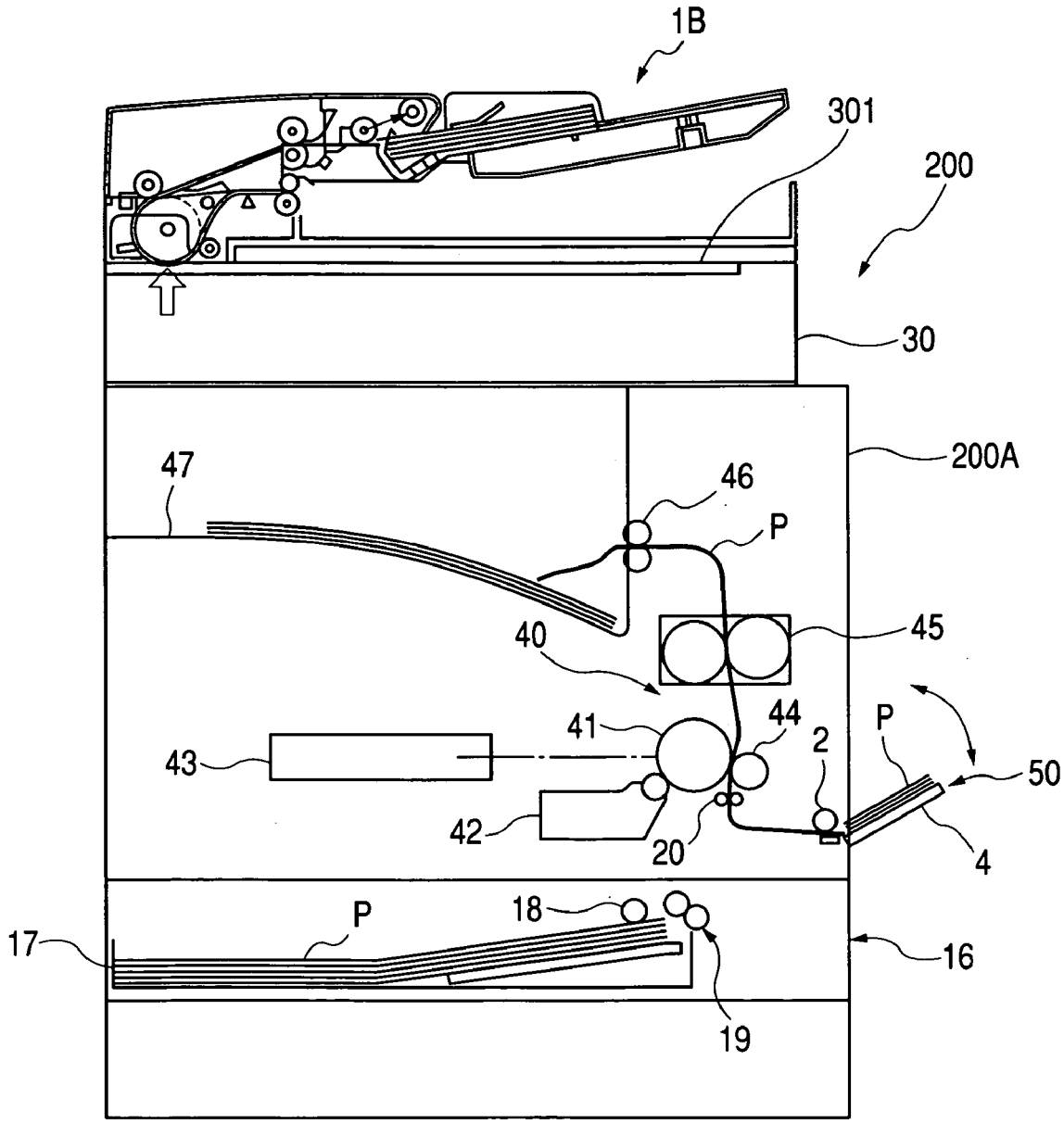
FIG. 1 schematically shows the construction of a copying machine which is an example of an image forming apparatus according to an embodiment of the present invention.

FIG. 1 schematically shows the construction of a copying machine which is an example of an image forming apparatus according to the embodiment of the present invention.

In FIG. 1, a scanner portion 30 which is an image reading portion is disposed in the upper portion of the copying machine main body (hereinafter referred to as the apparatus main body) 200A of the copying machine 200, an image forming portion 40 for forming an image on a sheet P is disposed in the central portion of the apparatus main body, and a cassette feeding portion 16 and a multi-feeding portion 50 for feeding the sheet P to the image forming portion 40 are disposed in the lower portion of the apparatus main body.

The image forming portion 40 has an electrophotographic photosensitive drum (hereinafter referred to as the photosensitive drum) 41, a developing device 42, etc. design is made such that when a laser beam corresponding to image information emitted from a laser scanner 43 is scanned on the surface of the photosensitive drum 41, a latent image is formed on the surface of the photosensitive drum, and this latent image is developed by the developing device 42, whereby a toner image is formed on the surface of the photosensitive drum.

Also, design is made such that when the sheet is thereafter transported to a transferring portion constituted by the photosensitive drum 41 and a transfer charging device 44, as will be described later, the toner image formed on the photosensitive drum 41 is transferred to the sheet.

On the other hand, the cassette feeding portion 16 is for feeding the sheets P to the transferring portion, and is provided with a cassette 17 loaded on the bottom of the apparatus main body 200A, and a sheet feeding roller 18 for feeding the sheets P contained in this cassette 17. Design is made such that during image forming, the sheet feeding roller 18 and a pair of retard rollers 19 are rotated in conformity with an image forming operation so as to separate and feed the sheets P one by one from the cassette 17.

The multi-feeding portion 50 is also for feeding the sheets P to the transferring portion, and is provided with a tray 4 which is sheet stacking means openably and closably provided in the apparatus main body 200A, and a sheet feeding roller 2 which is sheet feeding means for feeding the sheets P stacked on the tray 4. Design is made such that during image forming, the sheet feeding roller 2 is rotated in conformity with the image forming operation so as to feed the sheets P one by one from the tray.

On the other hand, the scanner portion 30 is for reading the image of an original placed on an original glass stand 301, and is adapted to convert image information into an electrical image signal after it has read the image of the original, and input this image information converted into the electrical image signal to the laser scanner 43 of the already described image forming portion 40.

Description will now be made of the image forming operation of the copying machine constructed as described above.

First, when the image information of the original is read by the scanner portion 30, this image information is image-processed and is thereafter converted into an electrical signal, and is transmitted to the laser scanner 43 of the image forming portion 40. In some cases, the image information is inputted from an external device such as a personal computer (not shown) to the image forming portion 40.

In the image forming portion 40, the surface of the photosensitive drum 41 is scanned by a laser beam corresponding to the image information emitted from the laser scanner 43 to thereby form a latent image on the photosensitive drum, whereafter this latent image is developed by the developing device 42 to thereby form a toner image on the surface of the photosensitive drum 41.

On the other hand, when in parallel to this operation, the sheets P are to be fed from the multi-feeding portion 50 to the image forming portion 40, the sheets P are fed one by one from the tray by the sheet feeding roller 2. Also, design is made such that when the sheets P are to be fed from the cassette feeding portion 16, the sheets P contained in the cassette are separated and fed one by one by the sheet feeding roller 18 and the pair of retard rollers 19.

The sheet P thus fed from the multi-feeding portion 50 or the cassette feeding portion 16 is then transported to register rollers 20. At this time, the register rollers 20 are at a halt, whereby the sheet P has its skew feed corrected, and is once stopped and stands by at this position.

Thereafter, the register rollers 20 are rotated and the sheet P having stood by is fed to the transferring portion constituted by the photosensitive drum 41 and the transfer charging device 44 in timed relationship therewith, and when the sheet P passes through this nip part, the toner image on the photosensitive drum is transferred to the sheet P.

The sheet P to which the toner image has been transferred in this manner is transported to a fixing apparatus 45, and the sheet P is heated and pressurized when it passes through the fixing apparatus 45, whereby the toner image is fixed on the surface of the sheet P. The sheet P on which the toner image has been thus fixed is thereafter delivered to a delivery tray 47 by sheet delivery rollers 46.

Figure 2:
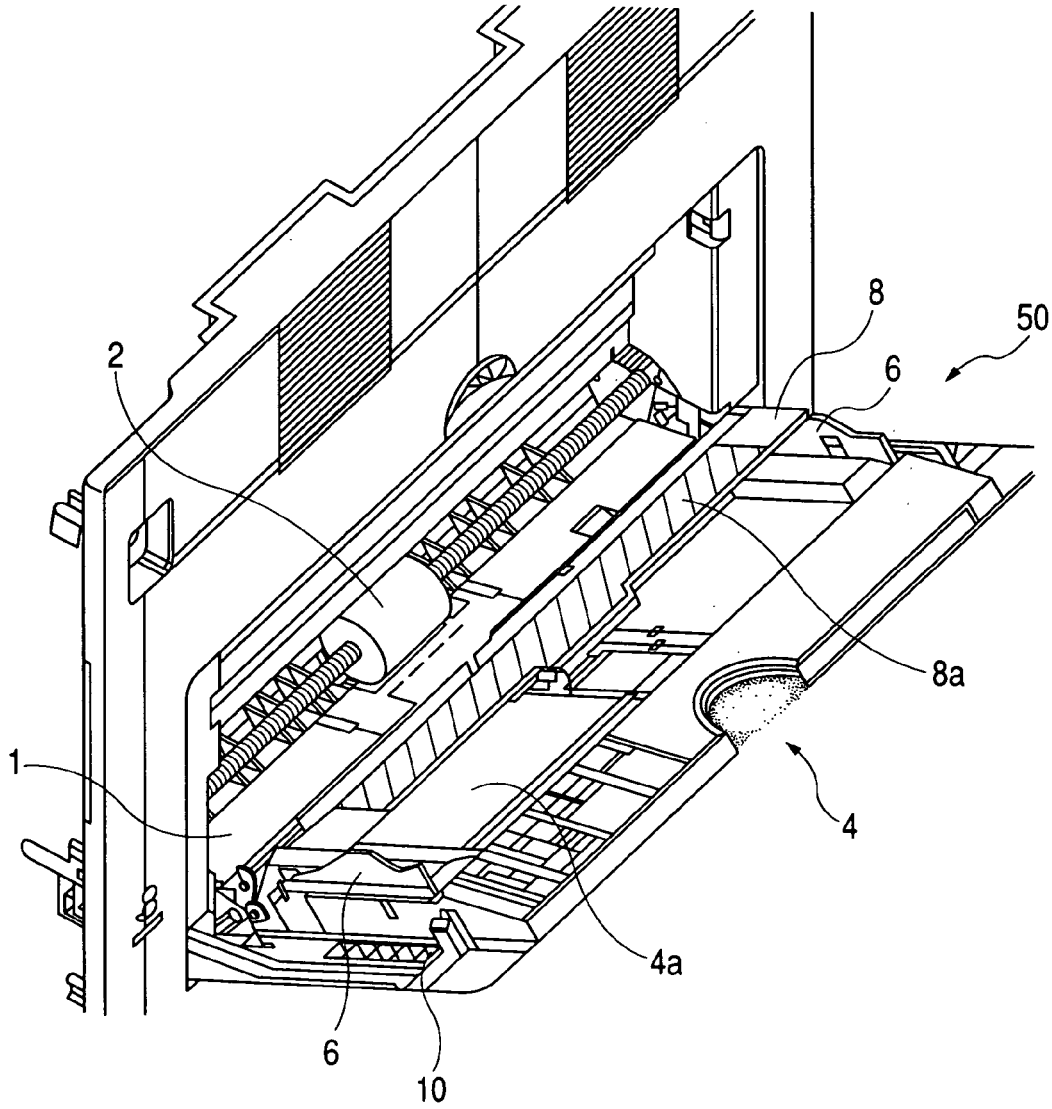
FIG. 2 is a perspective view illustrating the construction of the multi-feeding portion of the copying machine.

FIG. 2 is a perspective view illustrating the construction of the multi-feeding portion 50.

Figure 6:
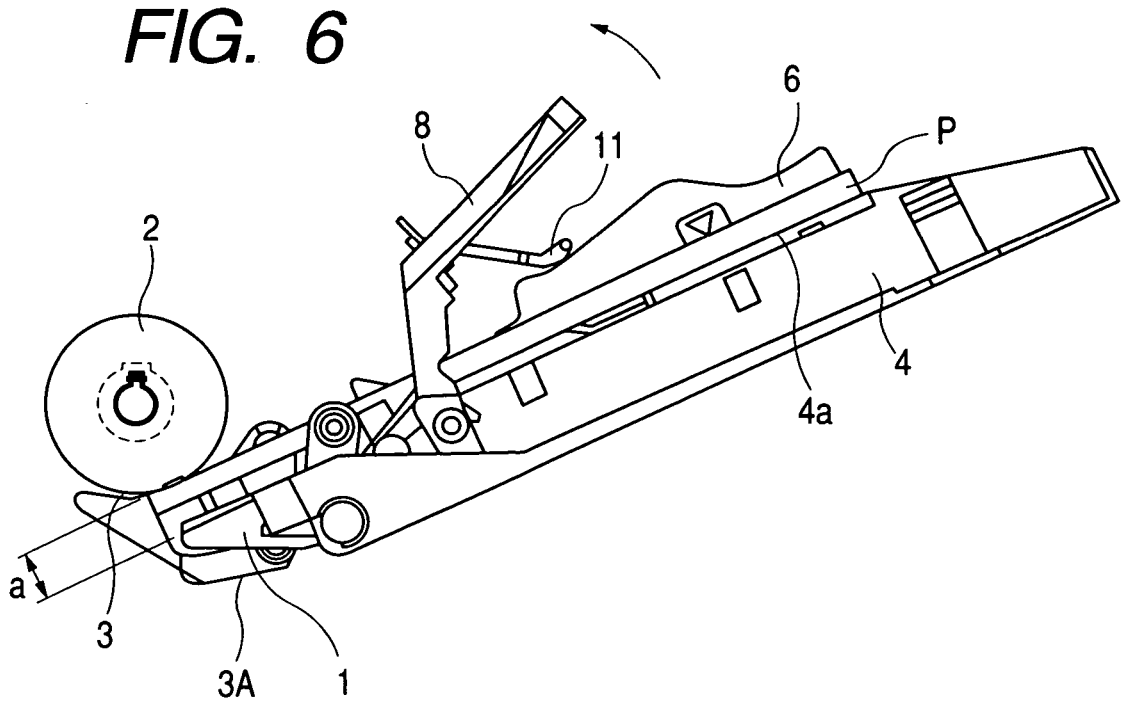
FIG. 6 illustrates the position of the intermediate plate when the lever is upwardly pivotally moved.

In FIG. 2, the reference numeral 1 designates an intermediate plate provided on that end portion of the tray 4 which is adjacent to the sheet feeding roller, i.e., below the sheet feeding roller 2, for pivotal movement (movement) in a vertical direction, and when the sheets are to be set on the tray 4, the intermediate plate 1 is adapted to be downwardly pivotally moved as shown in FIG. 6 which will be described later, and by the intermediate plate 1 being thus downwardly pivotally moved, a gap "a" equal to or greater than the thickness of the sheets to be set is formed between the sheet feeding roller 2 and the intermediate plate 1.

Figure 5:
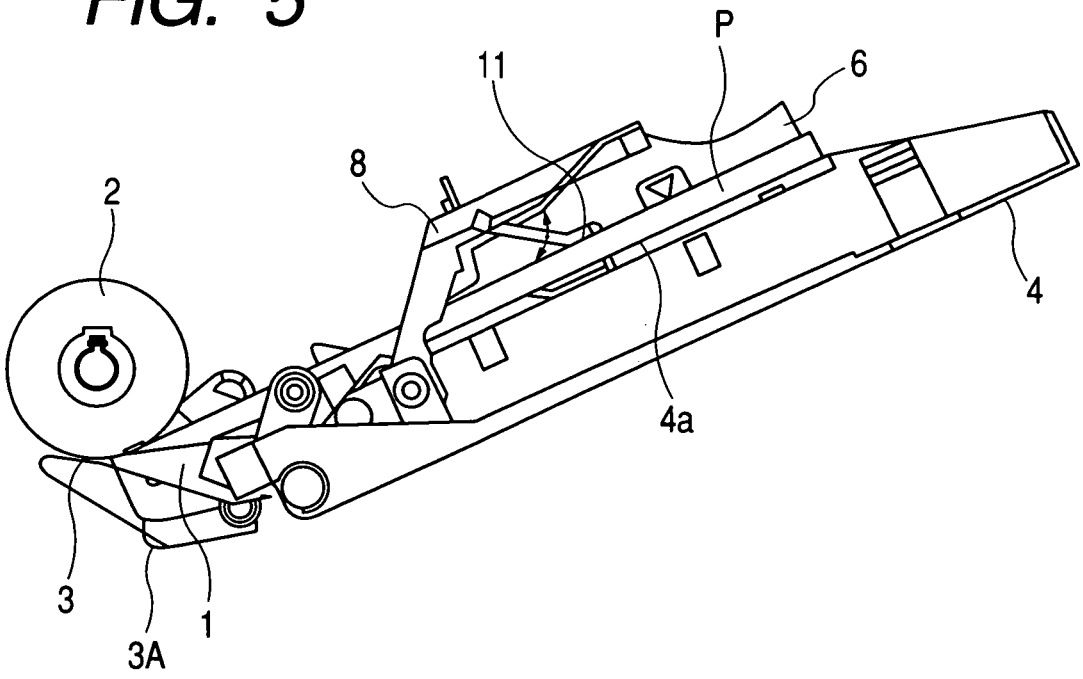
FIG. 5 illustrates the position of an intermediate plate when the lever is downwardly pivotally moved.

Also, when the sheets are to be fed, the intermediate plate 1 is adapted to be upwardly pivotally moved as shown in FIG. 5 which will be described later, and by the intermediate plate 1 being thus upwardly pivotally moved, the sheets can be brought into pressure contact with the sheet feeding roller 2, whereby when the sheet feeding roller 2 is rotated, the sheets come to be fed out.

A lever 8 which is a manually moving member for downwardly pivotally moving the intermediate plate 1 is provided above the sheet stacking portion 4*a* of the tray 4 and in a direction orthogonal to a sheet feeding direction. The opposite ends of this lever 8 are provided near side regulating plates 6 which are regulating members provided outside the opposite sides of the tray 4 and adapted to contact with the opposite side edge portions of the sheet and regulate the side edge positions of the sheet.

In the present embodiment, the lever 8 is provided so as to be astride of the side regulating plates 6 and the tray 4, and by the lever 8 being thus provided so as to be astride of the side regulating plates 6 and the tray 4, the size of the lever 8 can be made large, whereby the operability and visual perceptibility of the lever 8 can be improved.

Also, the lever 8 is disposed near the side regulating plates 6 used by the user in an ordinary operation, the visual perceptibility of the lever 8 is improved and the user can be prevented from losing sight of the presence of the lever 8. Further, as in the present embodiment, the lever 8 is provided so as to be astride of the side regulating plates 6 and the tray 4, whereby the lever 8 can be supported at the opposite end portions thereof and therefore, the rigidity of the lever 8 can be secured.

Figure 3:
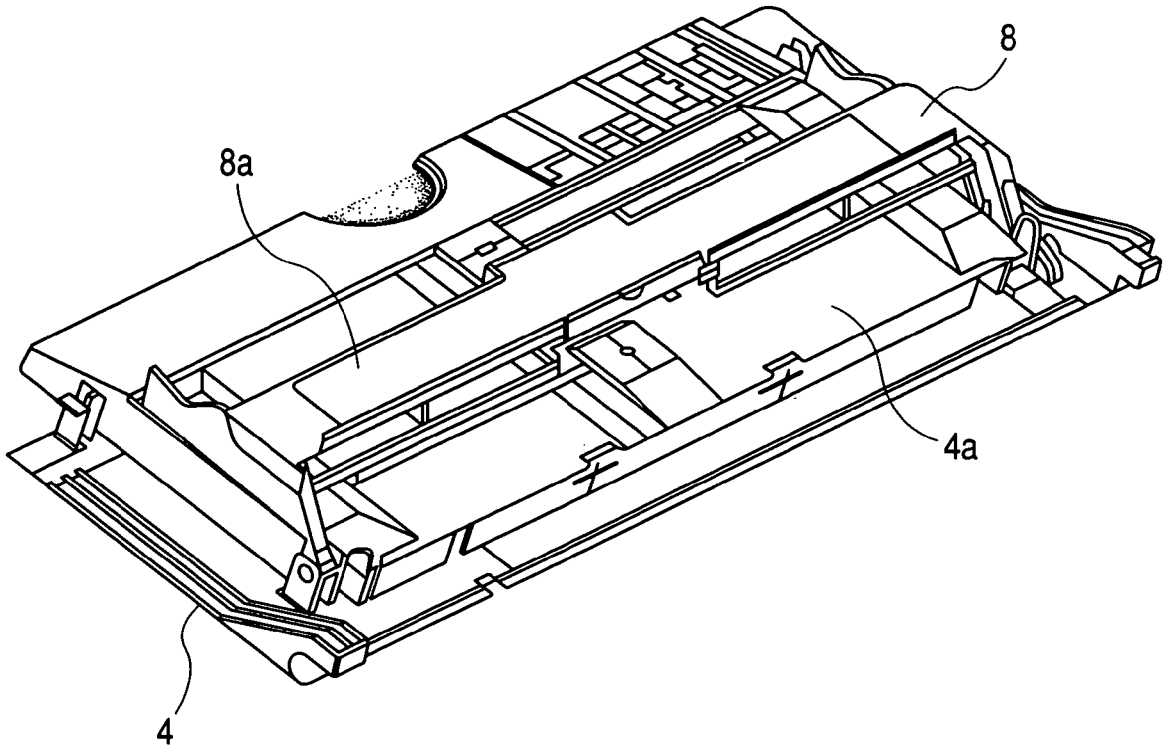
FIG. 3 is a perspective view illustrating the tray portion of the multi-feeding portion.

Furthermore, on the upper surface of the lever 8, there is formed an indicating portion 8*a* comprised of an index, an index label or the like indicating a user's operation or the like, as shown in FIG. 3. If required, this indicating portion 8*a* may also be formed on the back or the like of the lever 8.

The lever 8 is located above the sheet stacking portion 4*a* of the tray 4 and therefore, as the user looks at the lever 8 when he sets the sheets on the tray 4, the user comes to look at the indicating portion 8*a* formed on the upper surface of the lever 8 and thus, the visual perceptibility of the indicating portion 8*a* heightens, and it never happens that the effect thereof as an index is lost.

Figure 4A:
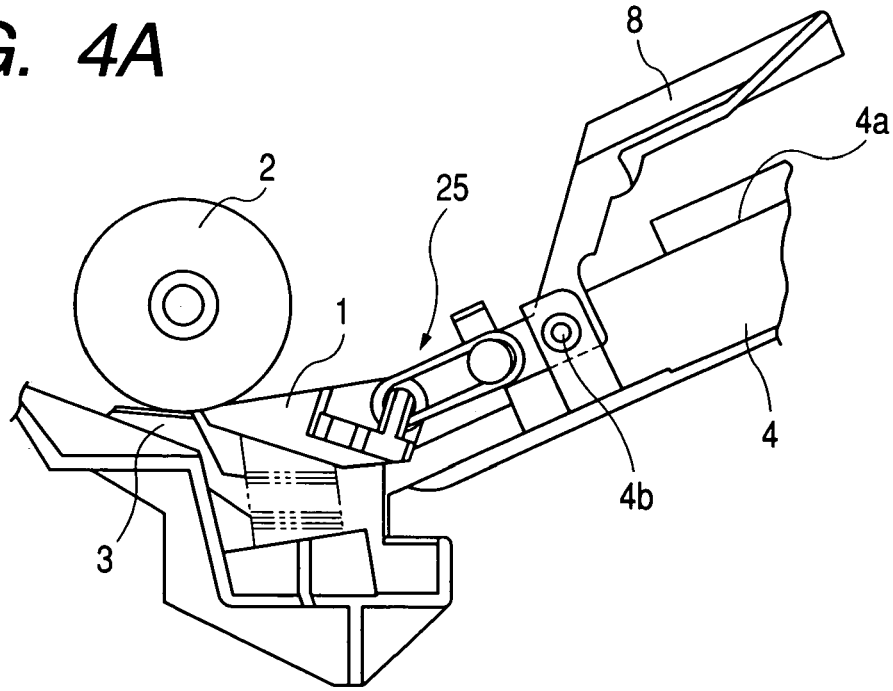
FIGS. 4A and 4B show the operation of a lever provided in the multi-feeding portion of the copying machine.
Figure 4B:
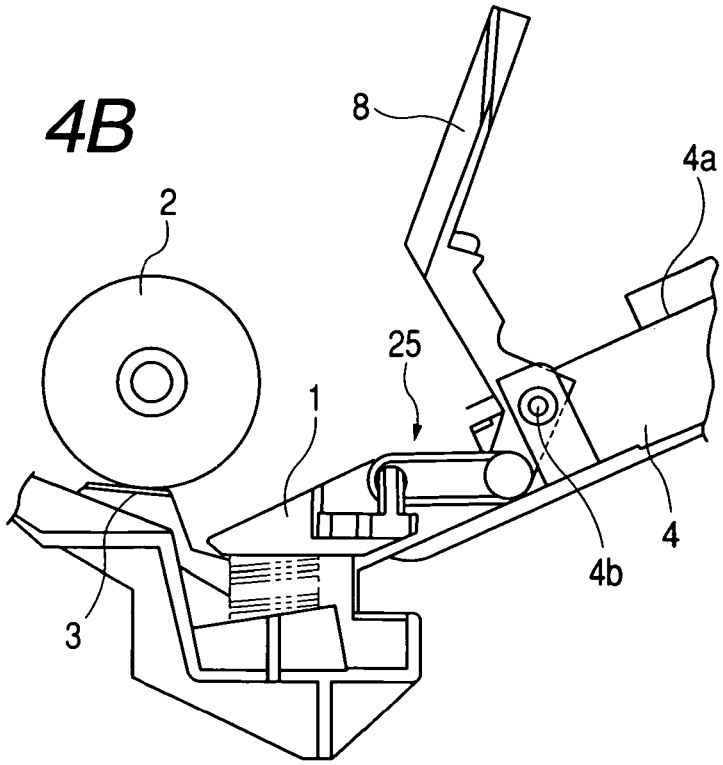

FIGS. 4A and 4B show the construction of the connection between the lever 8 and the intermediate plate 1, and the lever 8, as shown in FIGS. 4A and 4B, is supported on the tray 4 for pivotal movement in a vertical direction through a shaft 4*b* provided on the side portion of the tray 4, is supported to maintain an opening between lever 8 and tray 4, and is connected to the intermediate plate 1 pivotally supported through a link mechanism 25. Also, the intermediate plate 1 is upwardly biased by a spring 26.

When the lever 8 is downwardly pivotally moved as shown in FIGS. 4A and 5, the intermediate plate 1 is upwardly pivotally moved through the link mechanism 25, and the intermediate plate 1 is upwardly biased by the spring 26 and the sheets P come into pressure contact with the sheet feeding roller 2.

Also, when the lever 8 is upwardly pivotally moved as shown in FIGS. 4B and 6, the intermediate plate 1 is downwardly pivotally moved through the link mechanism 25 against the biasing force of the spring 26, whereby a gap "a" equal to or greater than the thickness of the sheets to be set is formed between the sheet feeding roller 2 and the intermediate plate 1, and the sheets P can be pushed in to below the sheet feeding roller 2. In FIGS. 5 and 6, a separating pad holder 3A holding the separating pad 3 on the upper end portion thereof is biased in a direction to bring the separating pad 3 into pressure contact with the sheet feeding roller 2 by biasing means, not shown.

Figure 7:
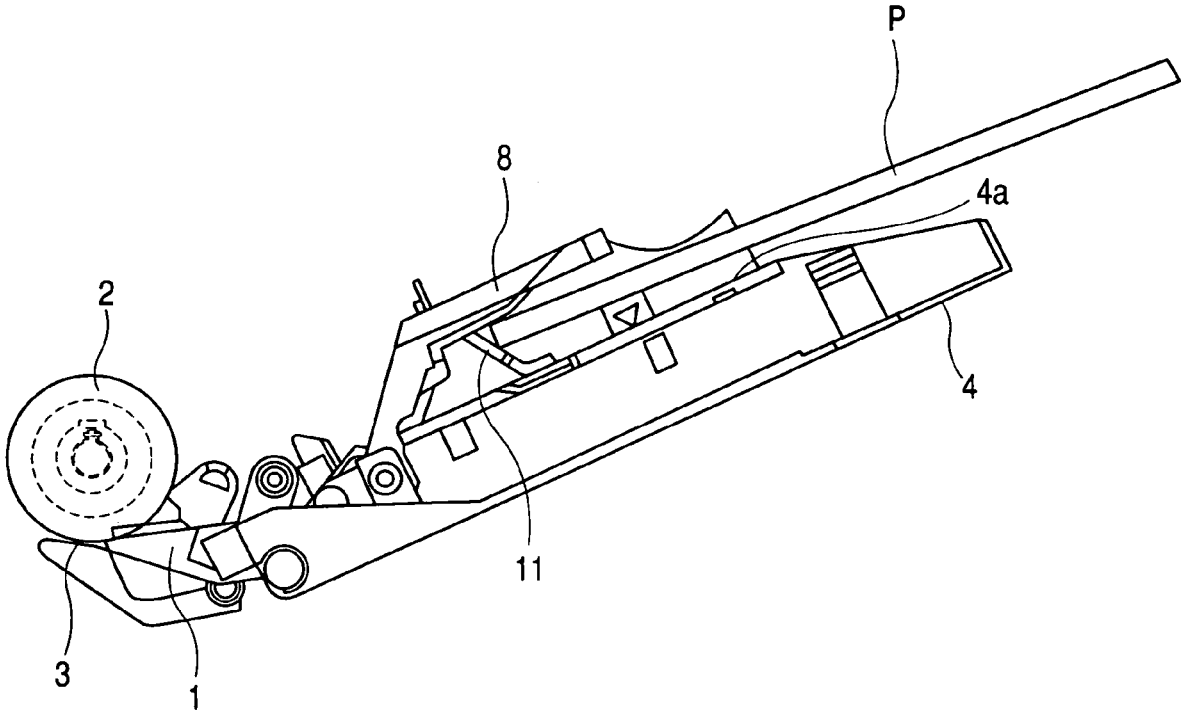
FIG. 7 shows a manner in which the insertion of sheets is hampered by a sheet stopper provided on the lever.

Now, as shown in FIG. 7, on the underside of the lever 8, there is pivotally supported a sheet stopper 11 which is a stopper member adapted to contact with or become proximate to the sheet stacking portion 4*a* of the tray when the lever 8 is downwardly pivotally moved as shown in FIG. 7. By such a sheet stopper 11 being provided, when the lever 8 is downwardly pivotally moved and the intermediate plate 1 has been moved to a first position in which the sheets P are brought into pressure contact with the sheet feeding roller 2, if an attempt is made to insert the sheets P, the insertion of the sheets P into between the sheet feeding roller 2 and the intermediate plate 1 is hampered by the sheet stopper 11, as shown in FIG. 7.

Design is made such that when the lever 8 has been thus downwardly pivotally moved, the insertion of the sheets P is hampered by the sheet stopper 11, that is, the sheets P cannot be inserted when the lever 8 is in its downwardly pivotally moved state, whereby when the user has forgotten the lever operation, the user can be made to recognize that he has forgotten the lever operation.

On the other hand, when as shown in FIG. 6, the lever 8 has been upwardly pivotally moved and the intermediate plate 1 has been moved to a second position in which the sheets P are spaced apart from the sheet feeding roller 2, that is, when the insertion (push-in) of the sheets P has become possible, the sheet stopper 11 separates from the sheet stacking portion 4*a* of the tray 4 and the sheets P become insertable. Thereby, the sheets P can be inserted, and the sheets P are set normally between the sheet feeding roller 2 and the intermediate plate 1.

When the lever 8 is downwardly pivotally moved after the lever 8 has been thus upwardly pivotally moved and the sheets P have been inserted, the sheet stopper 11 abuts against the sheets P as shown in FIG. 5, but as already described, the sheet stopper 11 is pivotally supported on the underside of the lever 8 and therefore, after it has abutted against the sheet P, it is upwardly pivotally moved. Thereby, even if the lever 8 is downwardly pivotally moved with the sheets P inserted (set), the sheet stopper 11 is kept in a position in which it contacts with the sheets P, and it never brings about an ill effect to the transport of the sheets P.

Also, the downwardly pivotally moved position of this sheet stopper 11 is regulated by a restraining member (not shown), and therefore, even when the lever 8 is upwardly pivotally moved as shown in FIG. 6, the sheet stopper 11 is held in a position in which the sheets P are insertable.

As described above, when the user has forgotten the operation of the lever 8 when he inserts the sheets P, the insertion of the sheets P is hampered by the sheet stopper 11 provided on the lever 8, whereby it can be suggested to the user that the operation of the lever 8 is necessary. Thereby, the user can reliably operate the lever 8 to thereby effect the changeover of a state in which sheet feeding is possible and a state in which the insertion of the sheets P is possible.

Figure 8:
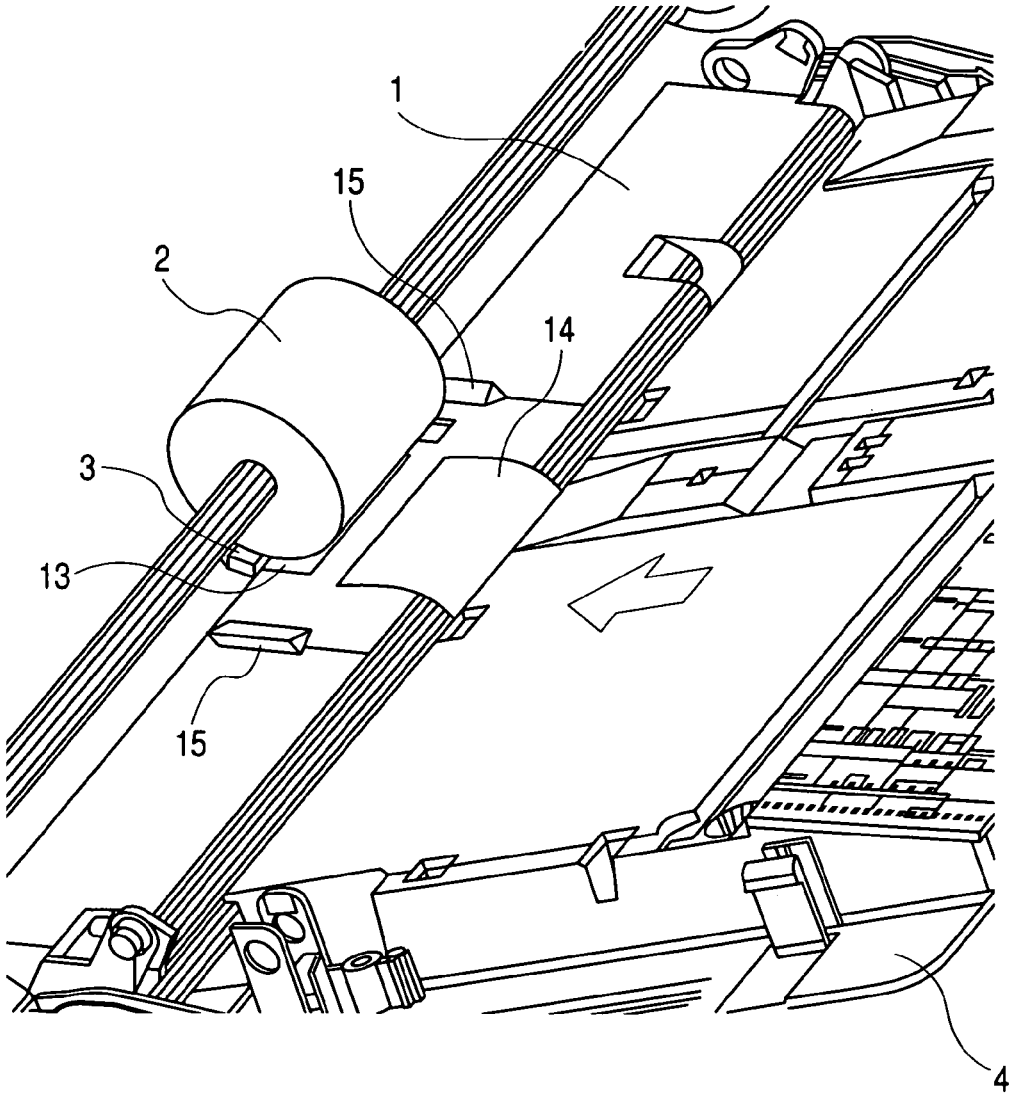
FIG. 8 is a perspective view showing the construction of the intermediate plate of the multi-feeding portion.

FIG. 8 is a perspective view showing the construction of the intermediate plate 1. In FIG. 8, an intermediate plate sheet 13 is provided at a location opposed to the sheet feeding roller 2, and an auxiliary intermediate plate sheet 14 is disposed upstream of the intermediate plate sheet 13.

By providing such an intermediate plate sheet 13 and such an auxiliary intermediate plate sheet 14, it is possible to give moderate back tension to the sheets P and therefore, double feed, and particularly, bundle double feed caused by a sheet bundle coming into between the sheet feeding roller 2 and the separating pad 3 can be prevented.

Cork or a rubber material such as urethane is suited as the material of the intermediate plate sheet 13 so as to be capable of standing the state of contact with such a sheet feeding roller 2 because the intermediate plate sheet 13 contacts with the sheet feeding roller 2 when the sheets are not stacked. Also, a material having a fur-like surface is suited as the material of the auxiliary intermediate plate sheet 14 because the auxiliary intermediate plate sheet 14 does not contact with the sheet feeding roller 2 and is not positively pressed through the sheets P.

Also, as shown in FIG. 8, regulating members 15 are provided on the intermediate plate 1 with the sheet feeding roller 2 interposed therebetween in order to prevent the sheet P from being off in the widthwise direction of the sheet P. These regulating members 15 may be formed integrally with the intermediate plate 1, or may be stuck on the intermediate plate 1.

Figure 9:
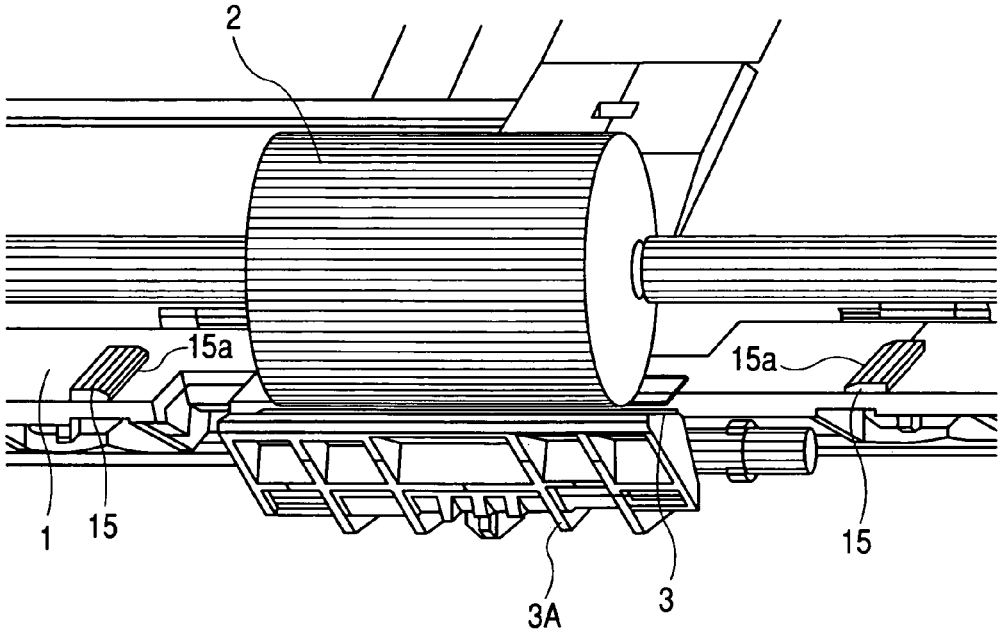
FIG. 9 is a view illustrating a regulating member provided on the intermediate plate.
Figure 10:
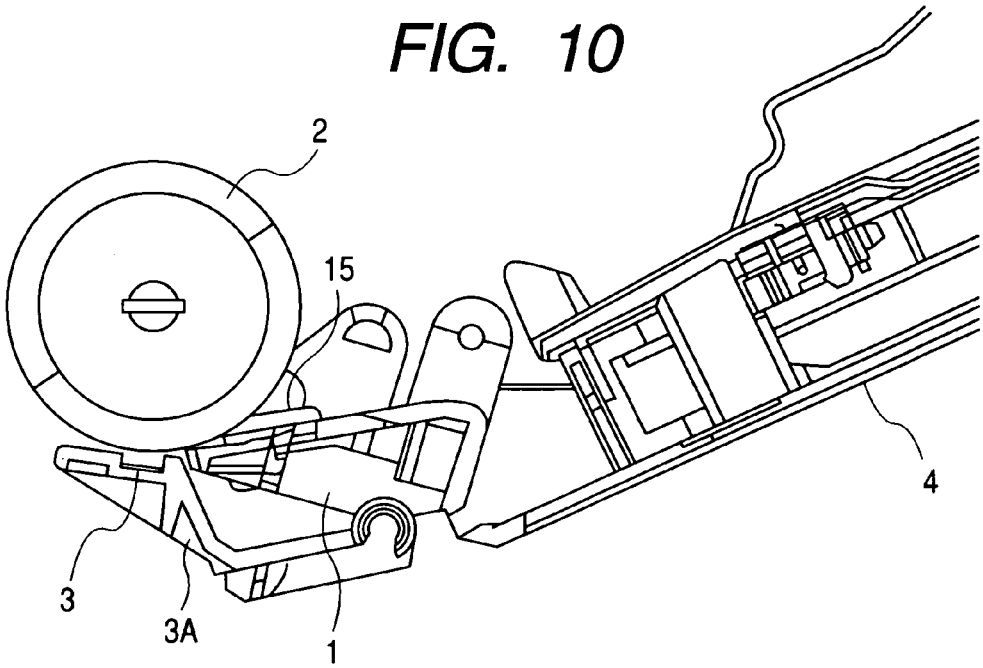
FIG. 10 is another view illustrating the regulating member provided on the intermediate plate.

Each of these regulating members 15 is provided with an inclined surface 15*a* facing the sheet feeding roller 2, as shown in FIG. 9. By the regulating members 15 being provided with such inclined surfaces 15*a*, even when during sheet feeding shown in FIG. 10, the sheets P deviate in the widthwise direction thereof relative to the sheet feeding roller 2, the sheets P have their deviation regulated by the regulating members 15 and it becomes possible to effect good transport.

Figure 11:
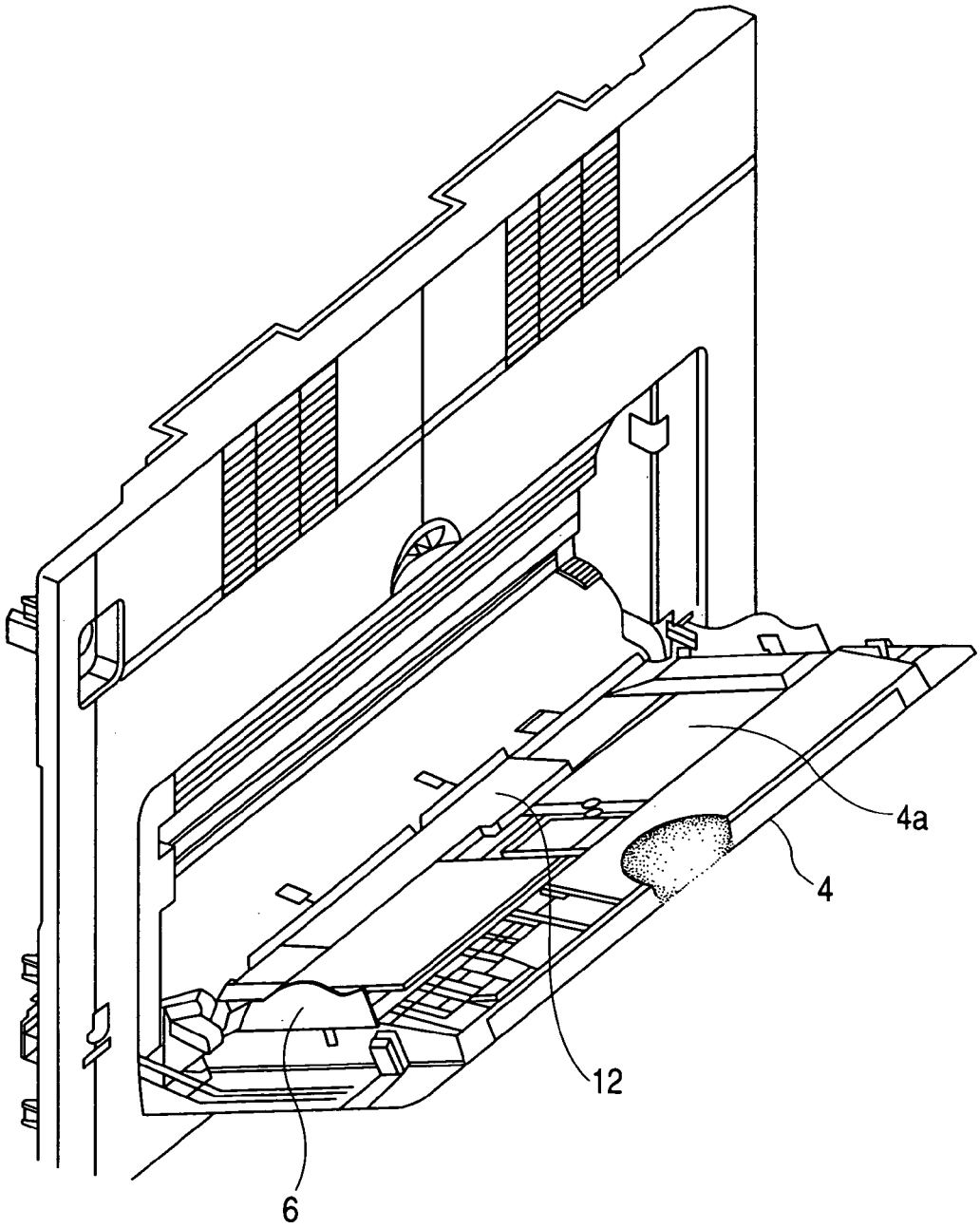
FIG. 11 is a perspective view illustrating a lever according to a modification of the present embodiment.
Figure 12:
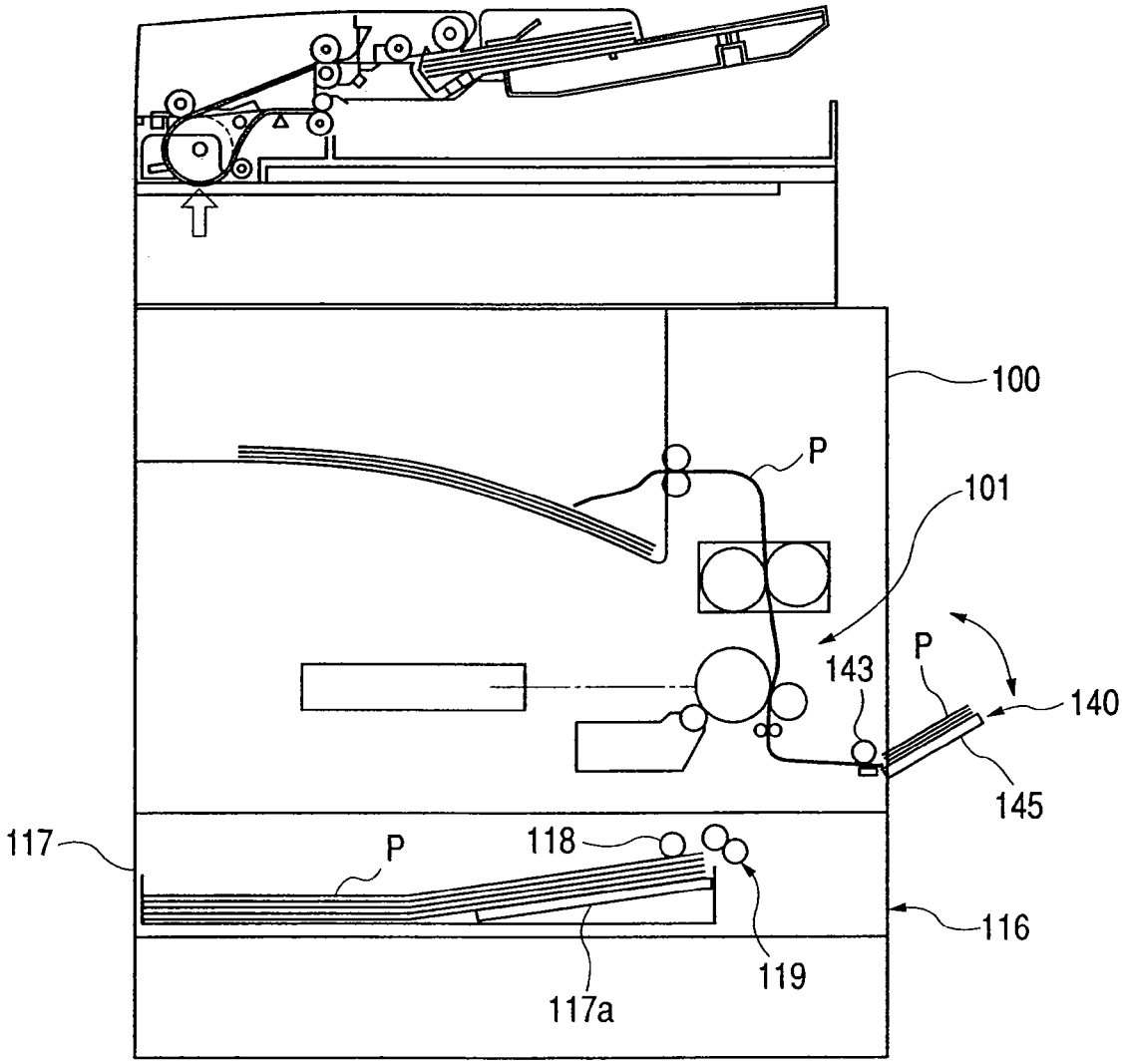
FIG. 12 PRIOR ART
FIG. 12 schematically shows the construction of a conventional image forming apparatus.
Figure 13:
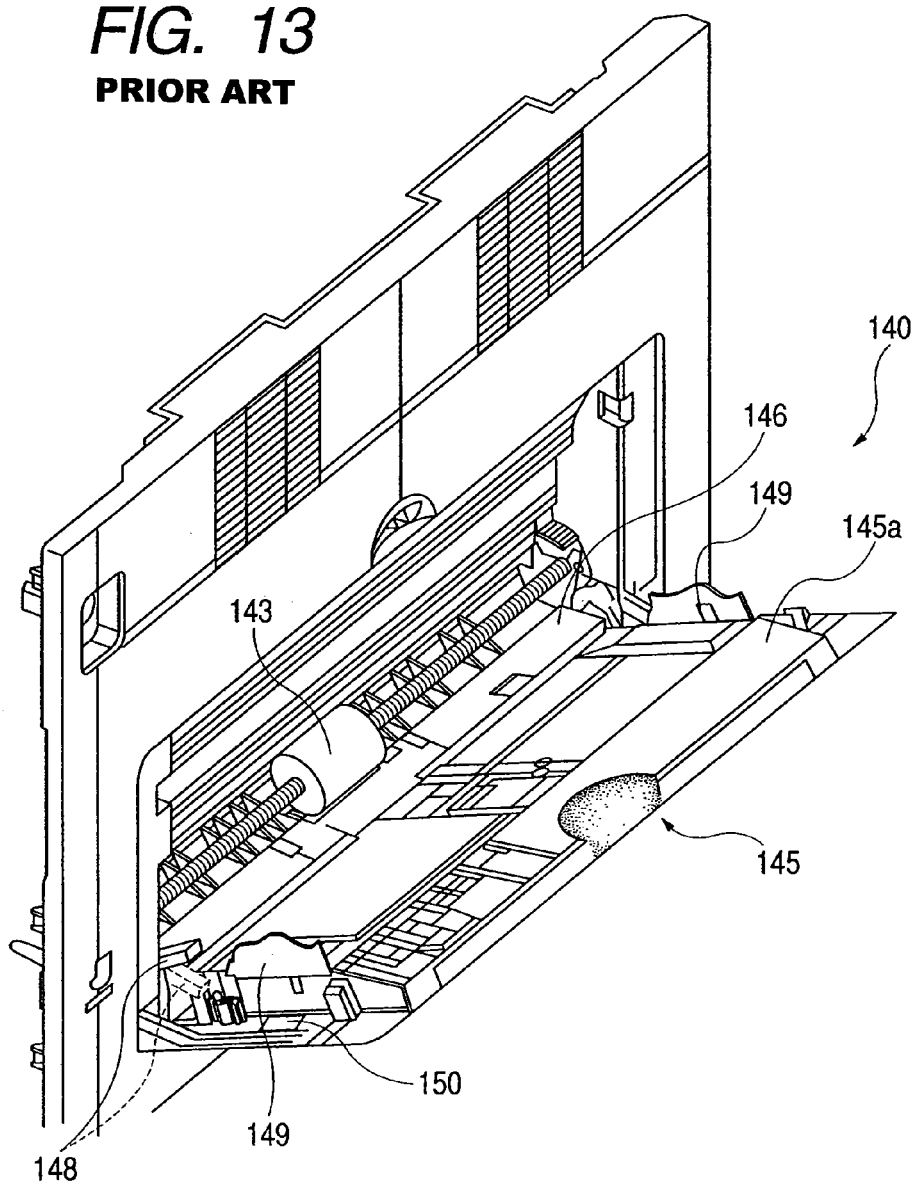
FIG. 13 PRIOR ART
FIG. 13 is a perspective view illustrating the construction of a multi-feeding portion provided in the conventional image forming apparatus.
Figure 14:
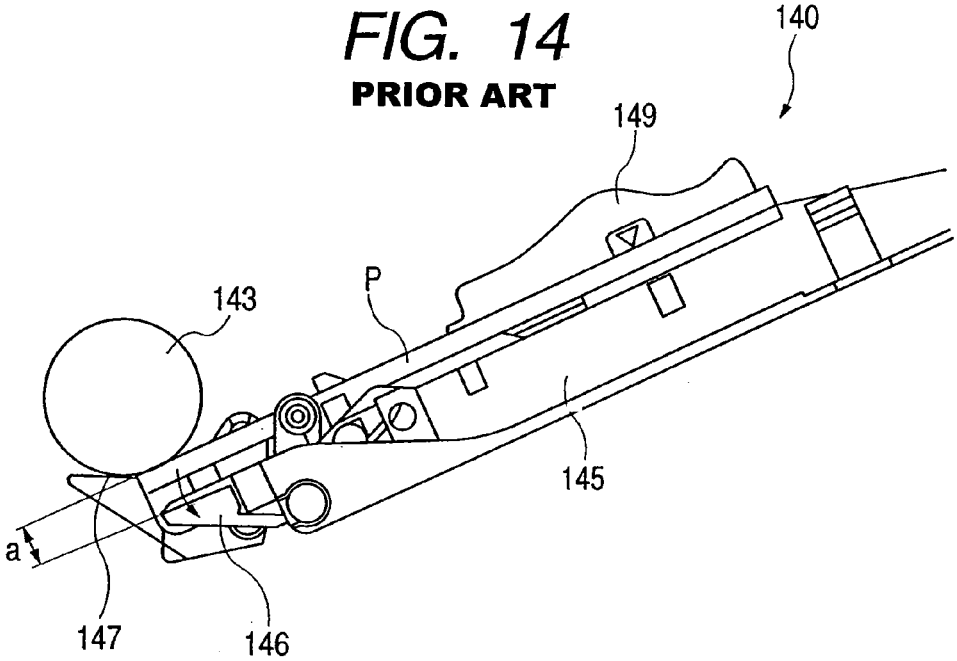
FIG. 14 PRIOR ART
FIG. 14 shows a state when an intermediate plate provided on the tray of the conventional multi-feeding portion is downwardly pivotally moved.
Figure 15:
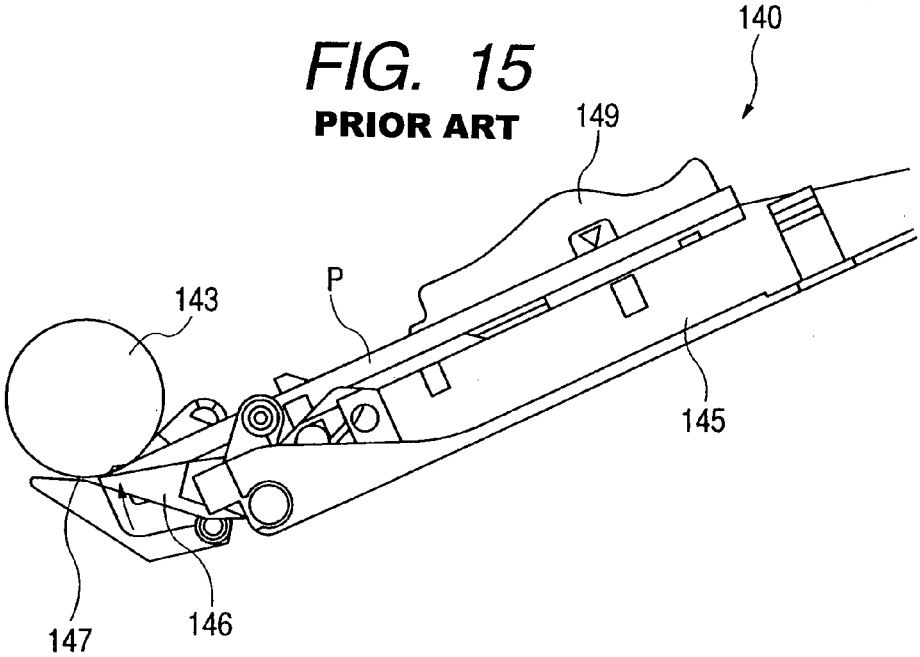
FIG. 15 PRIOR ART
FIG. 15 shows a state when the intermediate plate provided on the tray of the conventional multi-feeding portion is upwardly pivotally moved.
Figure 16:
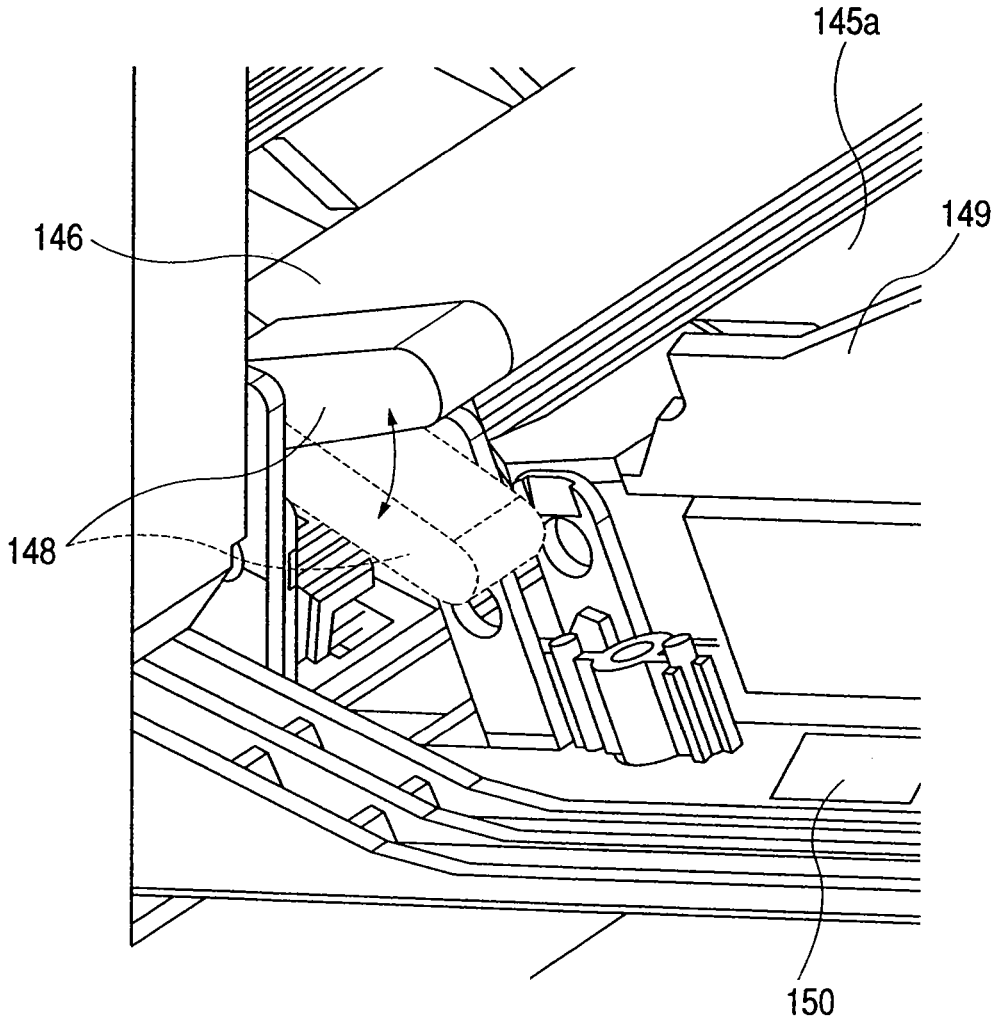
FIG. 16 PRIOR ART
FIG. 16 shows a lever for pivotally moving the intermediate plate provided on the tray of the conventional multi-feeding portion in a vertical direction.

While in the description hitherto made, a case where the lever 8 is disposed so as to be astride of the side regulating plates 6 and the tray 4 has been described, the present invention is not restricted thereto, but the lever 8 can be disposed so that at least one end thereof may be located near one of the side regulating plates 6 provided in opposed relationship with each other. As shown, for example, in FIG. 11, a lever 12 may be disposed, without being astride of the side regulating plates 6, so that one end thereof may be located near one of the side regulating plates 6.

Even if the lever 12 is thus disposed so that one end thereof may be located near one of the side regulating plates 6 and the lever 12 is supported in a cantilevered state, the lever 12 is present on the sheet stacking portion 4*a* of the tray 4 and therefore, a similar effect can be obtained.

Also, while in the description hitherto made, a case where the intermediate plate 1 provided on the fore end side of the tray 4 and supporting the leading edge side of the sheets is made pivotally movable in the vertical direction has been described as an example, the present invention is not restricted thereto, but can also be applied to a case where the tray supporting the whole of the sheets is pivotally movable in the vertical direction.

What is claimed is:

1. A sheet feeding apparatus comprising:

a tray which has a sheet stacking portion and an intermediate plate for supporting sheets thereon, wherein the tray is openably and closably provided in an apparatus main body;

a sheet feeding member which feeds the sheets;

a manually moving member which is selectively moved in a first direction to move said intermediate plate to a first position in which the sheets supported on said intermediate plate are brought into pressure contact with said sheet feeding member and in a second direction to move said intermediate plate to a second position in which the sheets supported on the intermediate plate are spaced apart from said sheet feeding member, wherein said manually moving member is disposed above the sheet stacking portion of said tray so as to partially cover the tray and in a direction orthogonal to a sheet feeding direction, and an opening through which a sheet is inserted onto said intermediate plate is formed between said manually moving member and said sheet stacking portion regardless of whether said manually moving member is moved in either the first direction or the second direction; and a stopper member which is pivotally mounted directly on an underside of said manually moving member and abuts against the sheet stacking portion or the sheets supported by the tray at a position upstream of said intermediate plate in an inserting direction of the sheet, wherein the stopper member hampers an insertion of the sheets through said opening onto said intermediate plate when said manually moving member is moved in the first direction, and the stopper member does not hamper the insertion of the sheets through said opening onto said intermediate plate when said manually moving member is moved in the second direction, and said stopper member abuts against the sheets stacked on said tray and is pivotally moved upwardly by contacting with the sheets stacked on said tray when said manually moving member has moved said intermediate plate to said first position.

2. A sheet feeding apparatus according to claim 1, wherein said manually moving member is provided in the direction orthogonal to said sheet feeding direction of said tray so as to be astride of said tray.

3. A sheet feeding apparatus according to claim 1, wherein said manually moving member is provided on one side end of said tray in the direction orthogonal to said sheet feeding direction, and is supported in a cantilevered state so as to extend from said one side end toward the other side end.

4. A sheet feeding apparatus according to claim 1, further comprising regulating members provided in opposed relationship with each other on opposite side portions of said tray in the direction orthogonal to said sheet feeding direction for contacting with opposite side edge portions of the sheets to thereby regulate the side edge positions of the sheets, wherein said manually moving member is disposed so that at least one end of said manually moving member in the direction orthogonal to said sheet feeding direction may be located near one of said regulating members disposed in opposed relationship with each other.

5. A sheet feeding apparatus according to claim 1, wherein an indicating portion for indicating an operation of said manually moving member is provided on at least an upper surface of said manually moving member.

6. A sheet feeding apparatus according to claim 1, wherein said stopper member moves to a position for hampering an insertion of the sheets into between said sheet feeding member and said tray when said manually moving member is in a state in which it has moved said intermediate plate to said first position, and moves to a position for not hampering the insertion of the sheets when said manually moving member is in a state in which it has moved said intermediate plate to said second position.

7. A sheet feeding apparatus comprising:

a tray which has a sheet stacking portion and an intermediate plate on which sheets are stacked, wherein the tray is openably and closably provided in an apparatus main body;

a sheet feeding roller rotatable while being in contact with sheets supported on said intermediate plate;

a pivotally movable lever connected to said intermediate plate through a link mechanism, wherein said link mechanism moves said intermediate plate upwardly by the pivotal movement of said pivotally movable lever in a first direction, and moves said intermediate plate downwardly by the pivotal movement of said pivotally movable lever in a second direction, wherein said lever is formed so as to extend above said sheet stacking portion and in a direction orthogonal to a sheet feeding direction by said sheet feeding roller, and an opening through which a sheet is inserted onto said intermediate plate is formed between said lever and said sheet stacking portion regardless of whether said lever is pivotally moved in either the first direction or the second direction; and a stopper which is pivotally mounted directly on an underside of said lever and abuts against the sheet stacking portion or the sheets supported by the tray at a position upstream of said intermediate plate in an inserting direction of the sheet, wherein the stopper is pivotally movable to a position for regulating the insertion of the sheets through said opening onto the intermediate plate during the pivotal movement of said lever in a direction towards said intermediate plate, and is pivotally movable to a position for permitting the insertion of the sheets through said opening onto the intermediate plate during the pivotal movement of said lever in a direction away from said intermediate plate, and said stopper abuts against the sheets stacked on said tray and is pivotally moved upwardly by contacting with the sheets stacked on said tray when said pivotally movable lever is moved in the first direction.

8. A sheet feeding apparatus according to claim 7, wherein said first direction is a direction of the pivotal movement toward said intermediate plate of said pivotally movable lever, and said second direction is a direction of the pivotal movement away from said intermediate plate of said pivotally movable lever.

9. A sheet feeding apparatus according to claim 7, wherein said lever is provided so as to be astride of said intermediate plate.

10. A sheet feeding apparatus according to claim 7, wherein said lever is provided in a cantilevered state so as to extend from one side end toward the other side end of said intermediate plate.

11. An image forming apparatus having an image forming portion for forming an image on a sheet, said image forming apparatus comprising:

a tray which has a sheet stacking portion and an intermediate plate for supporting sheets thereon, wherein the tray is openably and closably provided in an apparatus main body;

a sheet feeding member which feeds the sheets;

a manually moving member which is selectively moved in a first direction to move said intermediate plate to a first position in which the sheets supported on said intermediate plate are brought into pressure contact with said sheet feeding member and in a second direction to move said intermediate plate to a second position in which the sheets supported on the intermediate plate are spaced apart from said sheet feeding member, wherein said manually moving member is disposed above the sheet stacking portion of said tray so as to partially cover the tray and in a direction orthogonal to a sheet feeding direction, and an opening through which a sheet is inserted onto said intermediate plate is formed between said manually moving member and said sheet stacking portion regardless of whether said manually moving member is moved in either the first direction or the second direction; and a stopper member which is pivotally mounted directly on an underside of said manually moving member and abuts against the tray or the sheets supported by the tray at a position upstream of said intermediate plate in an inserting direction of the sheet, wherein the stopper member hampers an insertion of the sheets through said opening onto said intermediate plate moved in the first position by the manually moving member, and the stopper member does not hamper the insertion of the sheets through said opening onto said intermediate plate moved in the second position by the manually moving member, and said stopper member abuts against the sheets stacked on said tray and is pivotally moved upwardly by contacting with the sheets stacked on said tray when said manually moving member has moved said intermediate plate to said first position.

12. An image forming apparatus having an image forming portion, said image forming apparatus comprising:

a tray which has a sheet stacking portion and an intermediate plate on which sheets are stacked, wherein the tray is openably and closably provided in an apparatus main body;

a sheet feeding roller rotatable while being in contact with sheets supported on said intermediate plate;

a pivotally movable lever connected to said intermediate plate through a link mechanism, wherein said link mechanism moves said intermediate plate upwardly by the pivotal movement of said pivotally movable lever in a first direction, and moves said intermediate plate downwardly by the pivotal movement of said pivotally movable lever in a second direction, wherein said lever is formed so as to extend above said sheet stacking portion and in a direction orthogonal to a sheet feeding direction by said sheet feeding roller, and an opening through which a sheet is inserted onto said intermediate plate is formed between said lever and said sheet stacking portion regardless of whether said lever is pivotally moved in either the first direction or the second direction; and a stopper which is pivotally mounted directly on an underside of said lever and abuts against the sheet stacking portion or the sheets supported by the tray at a position upstream of said intermediate plate in an inserting direction of the sheet, wherein the stopper is pivotally movable to a position for regulating the insertion of the sheets through said opening onto the intermediate plate during the pivotal movement of said lever in a direction toward said intermediate plate, and is pivotally movable to a position for permitting the insertion of the sheets through said opening onto the intermediate plate during the pivotal movement of said lever in a direction away from said intermediate plate, and said stopper abuts against the sheets stacked on said tray and is pivotally moved upwardly by contacting with the sheets stacked on said tray when said pivotally movable lever is moved in the first direction.

* * * * *